US008485086B2

(12) United States Patent
Alis

(10) Patent No.: US 8,485,086 B2
(45) Date of Patent: Jul. 16, 2013

(54) SLIDE BEARING COMPONENT FOR PISTOL WITH LIGHT ALLOY BODY STRUCTURE

(76) Inventor: Latif Aral Alis, Duzce (TR)

( * ) Notice: Subject to any disclaimer, the term of this patent is extended or adjusted under 35 U.S.C. 154(b) by 50 days.

(21) Appl. No.: 13/029,757

(22) Filed: Feb. 17, 2011

(65) Prior Publication Data

US 2012/0210623 A1 Aug. 23, 2012

(51) Int. Cl.
*F41A 5/00* (2006.01)

(52) U.S. Cl.
USPC ..... 89/196

(58) Field of Classification Search
USPC ..... 42/71.02, 7; 89/195, 196
See application file for complete search history.

(56) References Cited

U.S. PATENT DOCUMENTS

| | | | | |
|---|---|---|---|---|
| 5,669,169 | A * | 9/1997 | Schmitter et al. | 42/75.01 |
| 5,717,156 | A * | 2/1998 | Lenkarski | 89/196 |
| 6,234,059 | B1 * | 5/2001 | Fuchs et al. | 89/196 |
| 6,993,864 | B1 * | 2/2006 | O'Clair et al. | 42/75.02 |
| 2006/0249014 | A1 * | 11/2006 | Curry | 89/196 |

* cited by examiner

*Primary Examiner* — Bret Hayes
*Assistant Examiner* — Reginald Tillman, Jr.
(74) *Attorney, Agent, or Firm* — Gokalp Bayramoglu

(57) ABSTRACT

This invention relates to countering of the weight caused by high temperature and pressure that arise during the firing of the pistol by this component, instead of the aluminum alloy body; by inserting, into the pistol with light alloy body structure, a bearing component that is all-steel, independent of the body of the pistol, and that can be assembled and disassembled when necessary; elimination of deformations of the aluminum alloy body caused by the high temperature and high pressure; and lengthening the working life of the pistol by increasing the rate of fire.

4 Claims, 3 Drawing Sheets

SLIDE BEARING COMPONENT FOR PISTOL WITH LIGHT ALLOY BODY STRUCTURE

FIELD OF THE INVENTION

This invention relates to carrying out the movement of slide on the body in pistols having light alloy body structure, via a bearing component; which is placed in slide bearing, which has a more durable structure than the body, and made from steel material.

BACKGROUND

Today, component of the pistols for bearing the barrel, known as slide, is made from steel, while its body component is made from aluminum alloy or made all-steel.

The pistols having aluminum alloy bodies are often preferred because they are inexpensive and light. However, the aluminum alloy bodies have certain disadvantages. For example, it is known that the aluminum body that comes into contact with steel slide abrades in time due to this contact and after some time it breaks. In addition to this, it has been observed that the aluminum, which has a quite low rupture-strain, cannot bear the load that arise during blast and that aluminum body crush during the firing of the pistol. For this reason, the aluminum alloy pistols are easy to use, yet their working lives are relatively limited.

In the state of the art, many alternative techniques have been tried in production of the body. For example, pistols having steel bodies have been produced; these are known to be heavier and much more robust compared to the aluminum. Here the aim is to eliminate deformations that arise as a result of the body's contact with the slide, and to lengthen the working life of the pistol by increasing its durability. Although the pistols with steel bodies that are much more resistant to the load that arise during blast of the pistol, result in lengthening of working life of the pistol, due to steel alloy's being relatively much heavier, they are not convenient for constant carriage and their use is difficult; therefore, these properties prevented such pistols from being preferred.

Also, although there has been attempts, as an addition to existent techniques, at production of pistols having both the body and slide made from aluminum; since the aluminum slide cannot bear the high load and heat that it is subjected to during the blast, it is not possible to produce the slide component of the pistol from aluminum.

Another material used in light alloy pistol bodies is titanium, which is known to be more durable than aluminum. However, titanium's being quite expensive precludes its advantage of durability. For this reason, pistols with titanium bodies are also not preferred often.

Pistols work through simple recoil force. When the bullet inside the barrel is fired, as the bullet is propelled forward within the barrel with the impact of the bullet's blast pressure, it pushes the slide backwards due to reverse force. The slide that is pushed backwards with backlash force begins to set the recovered recoil spring. With the effect of the set recoil spring, the slide, which comes to the distance calculated in design, rapidly returns to the position that it must rest. Pressure force that arise with the blast during the firing of the pistol, first impacts the slide that locks the barrel, then, with slide-barrel movement it impacts the body, and with the movement of the slide that is subjected to force and began to move, it impacts other components within the pistol. As it is understood, the more pressure impacts the body of the pistol, the bigger pressure impacts other components that make up the pistol and are inside the pistol. From time to time, this pressure force that acts on the said components that are inside the pistol may result in break down or breakage of these components. For this reason, in order to ensure a long working life for the pistol or other components that make up the pistol, the pressure force acting on these components must be kept at minimum.

This high pressure that arises during the blast has negative effects on the body of the pistol; these negative effects have been subject of certain patents and useful models. For example, in U.S. Pat. No. 1,563,675, elastic disks that are placed inside the body are used in order to counter the pressure and high energy that arise in pistols during firing. As for U.S. Pat. No. 1,754,689, once more, for countering the pressure that effect the body and absorbing a part of the energy that arise; between the slide and body, nylon material "delrin" is used, while in invention U.S. Pat. No. 3,756,121, nylon material "zytel" is used. As for U.S. Pat. No. 4,344,352, it mentions a recoil spring system that can counter the recoil force.

As it is understood, generally, the high energy and pressure that particularly act on the body and slide in pistols have been subject of many inventions and these inventions always take the direction of subsequent addition, to the pistol, of apparatuses having property of elasticity but have short working life; therefore, no long-lasting solutions have been found for the above mentioned deformation problem.

SUMMARY OF THE INVENTION

The bearing component (5) that is the subject of the invention is intended for prevention of deformations of the aluminum alloy body (1) caused by high temperature that arise during the firing of the pistol and weight that arise from pressure, and lengthening of the working life of the pistol.

BRIEF DESCRIPTION OF DRAWINGS

Explanations of the figures pertaining to the invention are as follows.

REFERENCES

Figure 1:
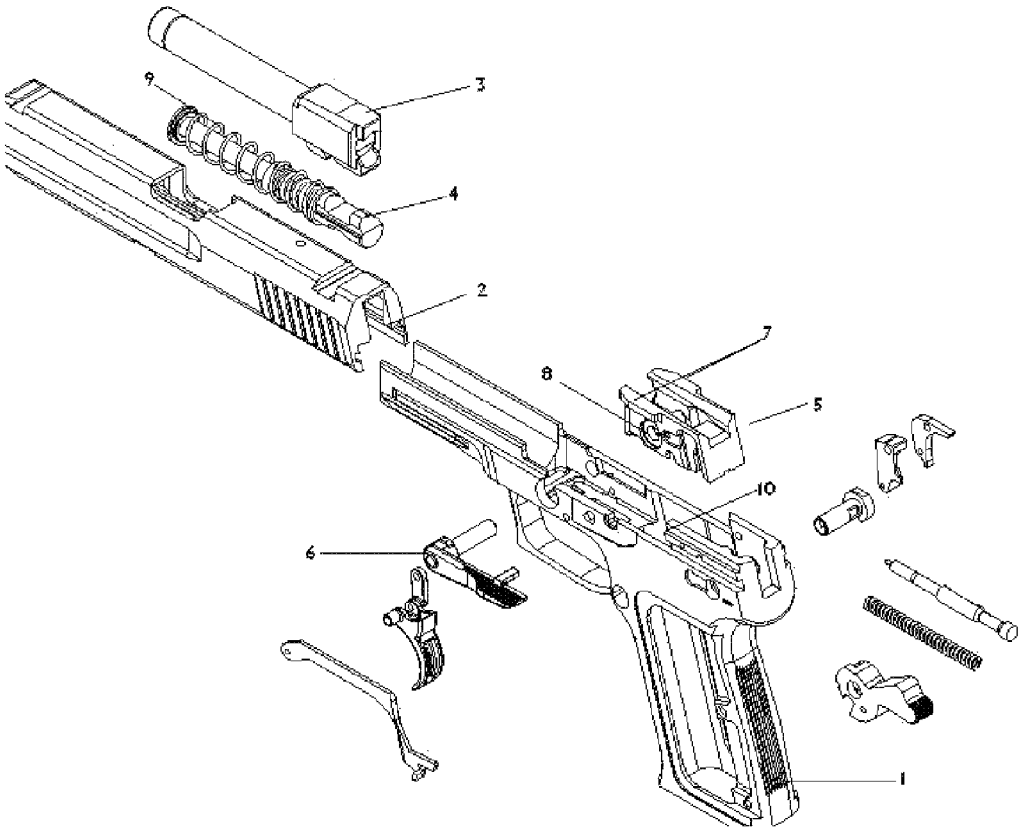
FIG. 1: General view of the light alloy pistol having the bearing component

1. Pistol body
2. Slide
3. Barrel
4. Recoil spring guide
5. Bearing component
6. Slide stop
7. Retaining pawl
8. Assembly hole
9. Recoil spring
10. Slide bearing

DESCRIPTION OF THE INVENTION

In the system that is subject of the invention, an area of the slide bearing (10) has the following characteristics: it engages with inner surface of the body (1) when placed inside the body (1), it has an outer surface geometry with a specially designed indented structure, it is independent of the body (1) of the pistol, it can be assembled and disassembled when necessary, and it is an all-steel production. The said slide bearing component (5) is inserted into the body (1) of the pistol that has aluminum alloy structure, to the slide bearing (10), and serves the function of bearing the slide (2).

Outer surface geometrical shape of the bearing component (5) that is the subject of the invention, has a specially designed indented structure that engage with the inner surface of the body (1), and at side surface edges there is one retaining pawl (7) for each surface, which enable the component (5) to fasten onto the body (1) also from the outside. When the slide bearding component (5) is inserted into the body (1) of the pistol, on each side there are assembly holes (8) into which the slide stop (6) will enter. Thus, the slide stop (6) that resides inside the body (1) also helps fastening of the bearing component (5) to the body (1).

In the pistols with light alloy body (1) having the bearing component (5) that is the subject of the invention; when the bullet inside the barrel (3) is fired, as the bullet is propelled forward within the barrel (3) with the impact of the bullet's blast pressure, due to reverse force it pushes the slide (2) backwards. The slide (2) that is pushed backwards with backlash force begins to set the recovered recoil spring (9). With the effect of the set recoil spring (9), the slide (2), which comes to the distance calculated in design, rapidly returns to the position that it must rest. The pressure force that arise with the blast during the firing of the pistol, first impacts the bearing component (5) that locks the barrel (3), and then it impacts other components within the pistol.

Owing to the steel bearing component (5) that is inserted into the slide bearing (10), in the area where the blast takes place, the slide mechanism (2) contacts not with the aluminum body (1), but with the steel bearing component (5). Thus, the aluminum body (1), which is indurable and has short working life, is not affected by the contact and the contact does not result in any deformations in the aluminum alloy body (1) of the pistol.

In present situation of the art, contrary to the above mentioned patent examples, the bearing component (5) has the following characteristics: it is not an elastic structure placed in the body (1) but it engages with inner surface of the body (1); it has an outer surface geometry with a specially designed indented structure; it is an all-steel production; it moves in combination with the pistol components such as the slide stop (6) and recoil spring guide (4) inside the pistol, and it can be assembled and disassembled when necessary.

The bearing component (5) placed inside the body (1) has many functions. As it is clear from its name, the bearing component (5) bears the slide (2) and by providing steel-steel contact in the area where the blasting takes place, prevents the contact of the aluminum alloy body (1) with the steel slide mechanism (2).

After the firing of the pistol, the barrel (3) makes a 3 degree angle with movement of the slide (2). Greatest function of the bearing component (5) is fastening the recoil spring guide (4) by containing the slide stop (6), bearing the barrel (3) with the help of the recoil spring guide (4), and fastening the barrel (3) that makes a 3 degree angle due to return of the slide (2) in this position, again with the help of the recoil spring guide (4). This situation, which recoil with backlash force and has the barrel (3) make a 3 degree angle, is of high-impact and all of this impact is countered by the bearing component (5).

Figure 2:
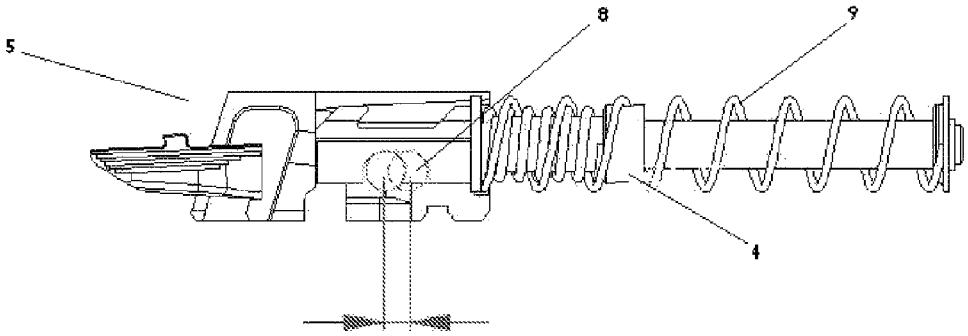
FIG. 2: Movement of the recoil spring guide during the moment of firing
Figure 3:
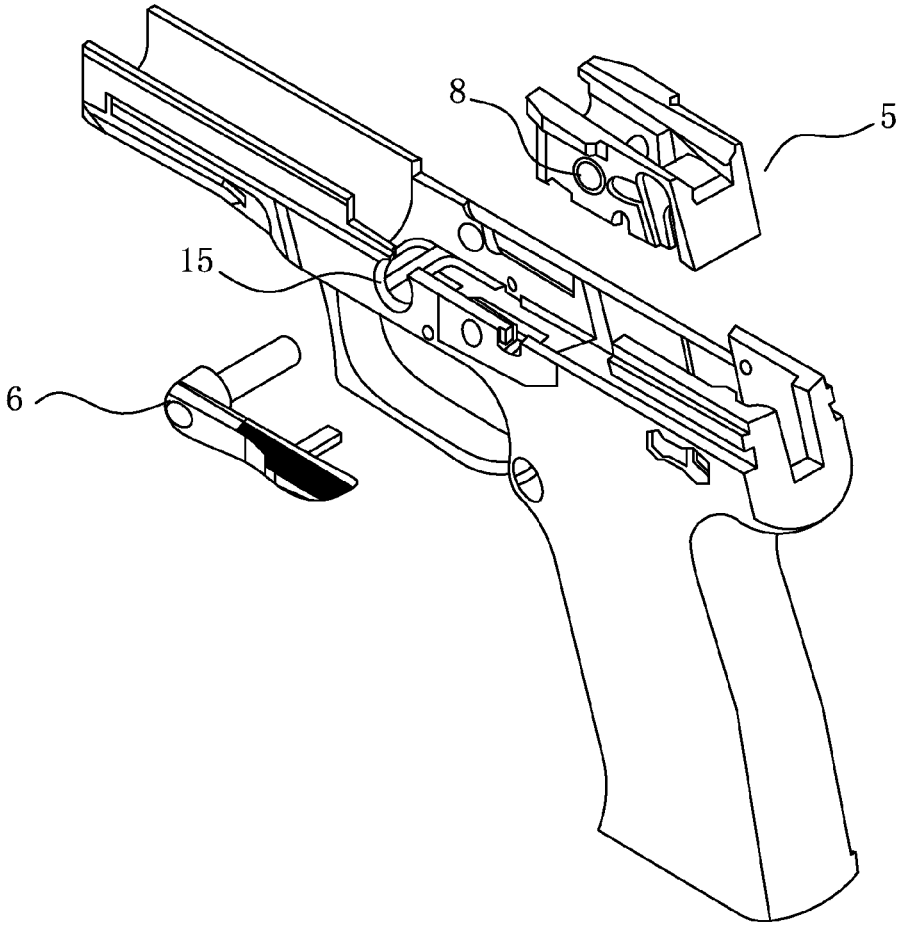
FIG. 3: Detailed view of the light alloy pistol having the bearing component.

Another function of the bearing component (5) that is the subject of the invention is its ability to bear and fasten the recoil spring guide (4), which is a movable component like the barrel (3), by containing the slide stop (6). Thus, as shown in FIG. 2, the said bearing component (5) determines the numeric value of the recoil spring guide (4), that is, it determines where the recoil spring guide (4) will stop during the firing and prevents the slide (2) from hitting the body (1). Thus, the loads that arise during the firing are countered not by the aluminum alloy body (1) but by the steel bearing component (5) and such negative effects as crushing and abrasion, which are caused by the loads that arise during the firing, are minimized.

Owing to the bearing component (5) that is the subject of the invention, a big part of the pressure force that arise during the blast with firing of the pistol is countered by the bearing component (5). By this means, loads coming to other components within the system are minimized and breakages and break downs that are often observed in these components are prevented to a great extent.

With the bearing component (5) that is the subject of the invention, working lives of the pistol and the components that make up the pistol are lengthened and a higher rate of fire is achieved.

Principles, preferred configuration, and manner of work of the present invention are described through the above explanations. However, this component (5) that is the subject of the invention, which is intended to be protected, must not be interpreted as limited only to the steel bearing component (5); all materials that are more durable than the light alloy body (1) of the pistol must be evaluated within the scope of the invention.

I claim:

1. A bearing unit comprising: an outer surface shaped to fit in a handgun body; a slide stop; a plurality of assembly holes located on each side of said bearing unit; wherein the slide stop enters into the handgun body and into at least one assembly hole; and plurality of retaining pawls on each side surface of said bearing unit; wherein the bearing unit moves in combination with the slide stop and a recoil spring guide; and wherein the handgun body is made of a light metal alloy material.

2. The bearing unit of claim 1; wherein the bearing unit fastens the handgun barrel in its position by bearing it with the help of the recoil spring guide.

3. The bearing unit of claim 1; wherein the bearing unit fastens a recoil spring guide by containing the slide stop.

4. The bearing unit of claim 1; wherein during the firing of the pistol, it prevents the slide from hitting the body by fastening the slide stop.

* * * * *